United States Patent [19]

McNair

[11] 3,934,597

[45] Jan. 27, 1976

[54] HAIR CURLING INSTRUMENT

[75] Inventor: Samuel L. McNair, Overland Park, Kans.

[73] Assignee: Dazey Products Co., Kansas City, Mo.

[22] Filed: July 17, 1974

[21] Appl. No.: 489,133

[52] U.S. Cl. ..... 132/37 R; 132/9

[51] Int. Cl.[2] ..... A45D 2/24

[58] Field of Search..... 132/9, 32 R, 33, 36, 37 R; 219/222, 224

[56] References Cited

UNITED STATES PATENTS

| | | | |
|---|---|---|---|
| 1,504,567 | 8/1924 | MacDonald et al. | 132/33 R |
| 2,254,266 | 9/1941 | Cannon | 132/37 R |
| 3,768,491 | 10/1973 | Barradas | 132/37 R |
| 3,835,292 | 9/1974 | Walter | 132/32 R |

FOREIGN PATENTS OR APPLICATIONS

| | | | |
|---|---|---|---|
| 81,115 | 9/1956 | Denmark | 132/9 |

*Primary Examiner*—G. E. McNeill

*Attorney, Agent, or Firm*—Lowe, Kokjer, Kircher, et al.

[57] ABSTRACT

A hair curling instrument for steam treating hair wound thereon by dispensing steam through a plurality of steam passage holes includes means for inhibiting the escape of liquid through the holes. The device comprises a handle having a generally cylindrical steam tube attached thereto, and a spring biased, thumb-operated clamp mounted on the steam tube for securing the hair on the tube for curling. The steam tube includes an outer shell having a cylindrical heating tube of a smaller diameter coaxially positioned therewithin. An annular steam chamber defined between the outer shell and the heating tube receives liquid from a resilient, liquid injecting syringe which is removably and sealably attached to the opposite end of the steam tube. The syringe comprises a symmetrical squeeze bulb which is tapered to conform to the profile of the steam tube and an interconnected stem portion. When liquid injected into the steam chamber by the bulb contacts the adjoining heater tube, the steam produced therebby escapes from the steam passage holes located in the steam tube shell. A baffle is sandwiched between the heating tube and the outer shell of the steam tube to inhibit the escape of bubbling water through the steam holes while freely permitting the passage of steam or other vapors therethrough.

2 Claims, 3 Drawing Figures

HAIR CURLING INSTRUMENT

BACKGROUND AND SUMMARY OF THE INVENTION

This invention relates to hair curling instruments. More particularly the invention relates to hair curlers which include a handle having a rod-like, electrically heated tube at one end on which a strand of hair is wound, and a thumb-operated clamp to secure the hair on the tube for treatment with heat and/or steam.

It is well known in the prior art to employ steam dispensing hair curling instruments constructed generally as described above in the treatment and setting of hair. Representative prior art devices are disclosed by Barradas, U.S. Pat. No. 3,768,491; Brown, U.S. Pat. No. 3,610,259; Van Droogenbroek, U.S. Pat. No. 3,220,421; Jones, U.S. Pat. No. 2,880,299; and Cannon, U.S. Pat. No. 2,254,266.

Many of the prior art devices however are deficient in one or more respects. For example, one of the major problems in the prior art is that liquid tends to leak outwardly through the steam passage holes when the curling instrument is oriented in certain positions. In part, to remedy this difficulty some of the prior art devices utilize an absorbent wick for receiving the treatment liquid. This approach, which only partially solves the leakage problem, unnecessarily limits the capacity of the fluid vaporization chamber and adds to the complexity and cost of the device.

Another problem with some of the prior art devices relates to the fluid injection systems utilized therewith for delivering liquid to the vaporization chamber. To inhibit fluid leakage complex mechanical valves employing springs, nozzles, or the like are sometimes utilized. As a result manufacturing costs are increased. Additionally the prior art fluid injection systems often comprise protuberant parts which contribute to structural dissymmetry and interfere with hair curling.

Furthermore, some prior art fluid injection designs may increase electrical shock hazards for the user. The construction of some prior art hair curlers makes it possible, if not likely, that the user will attempt to fill the device with liquid while it is still connected to a source of electricity, thereby exposing himself to a serious electrical shock hazard.

It is accordingly a fundamental object of this invention to provide a steam dispensing hair curling instrument which is adapted to prevent the passage of water through the associated steam ejector holes.

It is another object of this invention to provide a hair curling instrument of the character described which does not utilize an absorbent wick to prevent the said leakage of fluids.

Another object of this invention is to provide a hair curling instrument having a fluid injection system which does not utilize complex mechanical valves.

Yet another object is to provide a hair curling instrument of the character described with a generally symmetrical fluid injection structure which does not interfere with the wrapping or curling of hair.

A still further object of this invention is to provide a hair curling instrument of the character described with a fluid injection structure having a detachable fluid reservoir which may be filled with liquid without subjecting the user thereof to electrical shock hazards. In the present invention the aforementioned syringe must be detached from the device for filling with fluid, so that shock hazards are reduced by the resultant electrical isolation.

The preferred hair curling instrument of the present invention has a generally cylindrical handle with a rod-like steam dispensing tube attached thereto. The steam dispensing tube comprises a cylindrical heater tube, which houses an electrically resistive heater wire, and a cylindrical outer shell, into which the heater tube is axially inserted. The handle is channeled to receive electrical conductors which extend therethrough to energize the heater wires and produce heat. An annular steam chamber is defined in part between the walls of the heater tube and the cylindrical outer shell. Fluid is injected into the steam chamber by a syringe which is removably attached to the end of the steam dispensing tube. The syringe comprises a hollow, preferably molded rubber squeeze bulb which is symmetrically tapered to conform to the profile of the steam tube to thereby minimize interference with hair curls. Since the syringe must be removed from the steam tube in order to be filled with liquid, potential electrical shock hazards are significantly reduced.

Steam or vapor produced when liquid contacts the heater tube escapes through a plurality of steam passage holes which are provided in the outer shell of the steam dispensing tube. An insert or baffle is sandwiched between the heater tube and the steam tube shell to inhibit the passage of water through the adjacent passage holes while at the same time facilitating the passage of steam or vapor therethrough.

Other and further objects related to this invention will appear in the course of the following description.

DESCRIPTION OF THE DRAWINGS

In the following drawings, which form a part of the specification and are to be read in conjunction therewith, and in which like reference numerals are employed to represent like parts in the various views.

Figure 1:
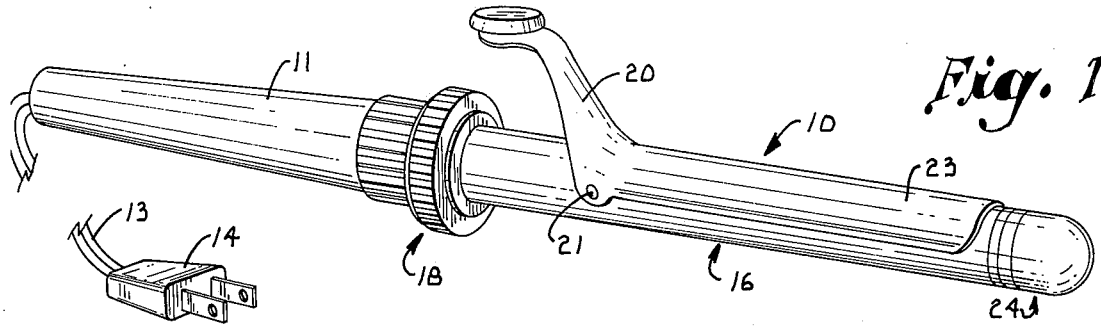
FIG. 1 is a perspective view of a hair curling instrument constructed in accordance with the teachings of this invention.

Referring now to the drawings, and more particularly to FIG. 1, the hair curling instrument is generally identified by the reference numeral 10. The instrument comprises an elongated cylindrical handle 11 which is channeled lengthwise to provide room for a conventional two conductor electric cord 13 for connection with an AC outlet via plug 14. Handle 11 is preferably constructed from a material such as plastic or the like which has low thermal conductivity. A tubular, cylindrical steam tube 16 is interconnected with handle 11 by a flange connection (not shown) within a somewhat greater diameter handle portion 18. A thumb-operated clamp 20 is pivotally mounted to steam tube 16 by pivot pin 21 for securing hair to the steam tube for curling. The clamp 20 is springably biased by spring 22 (FIG. 2) so that a longitudinal clamp portion 23 will normally contact the steam tube 16 (or curls of hair wound thereon). As will be discussed later, a syringe 24 is removably connected to the end of steam tube 16.

Figure 2:
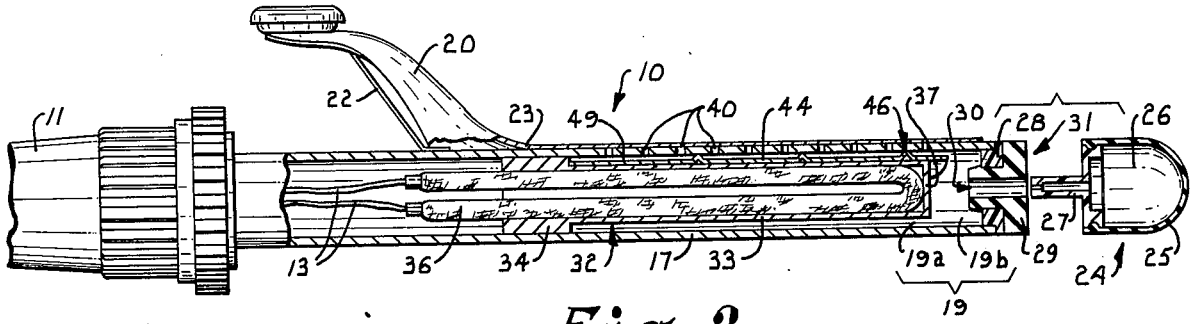
FIG. 2 is a side elevational view of the same showing the steam tube in longitudinal section with the fluid injection syringe detached therefrom.

With reference to FIG. 2, steam tube 16 comprises a generally tubular, cylindrical outer shell 17 and a generally tubular, cylindrical heating tube 32, which is coaxially received within shell 17. Shell 17 and heating tube 32 are preferably constructed from lightweight material having good thermal conductivity, such as aluminum. Heating tube 32 receives a conventional electrically resistive heater element (not shown) which is housed within a glass fiber sleeving 36 and electrically connected to conductors 13 for producing heat. Tube 32 comprises a thin wall cylinder portion 33 and an integrally formed, larger diameter shoulder portion 34. The outside diameter of portion 34 is approximately equal to the interior diameter of shell 17, so that portion 34 will contact shell 17 to maintain tube 32 in concentric alignment therewith. Portion 34 is sealed to shell 17 by, preferably, a silicone based rubber cement to provide a leakproof seal.

The steam tube 16 also forms a steam chamber 19 around and in front of the heater tube 32. Chamber 19 consists of a first annular portion 19*a*, which is defined between shell 17 and coaxial portion 33, and a second portion 19*b*, which is located between the anterior end 37 of tube 32 and the anterior end 31 of shell 17. The steam chamber is in communication with an orifice 30 at the end of shell 17 and a plurality of steam passage holes 40 which are provided at appropriate intervals in a portion of the upper cylindrical surface of shell 17.

A detachable syringe 24 includes a resilient, collapsible bulb portion 25 and a tubular stem portion 27 which is coupled to the bulb. Syringe 24 is adapted to be squeezably manipulated like an eye dropper in order to intake and discharge water. Bulb 25, which is preferably constructed of molded rubber, has an interior reservoir 26 for containing the water. The end 23 of shell 17 is fitted with a bushing 28, preferably a phenolic, which receives a grommet 29. Stem portion 27 is adapted to be removably and sealably received within the orifice 30 in the grommet.

When the syringe 24 is attached to the steam tube 16, reservoir 26 will be in communication with chamber 19 via stem portion 27. The syringe 24 is symmetrically profiled so that it does not interfere with the curling of hair.

Figure 3:
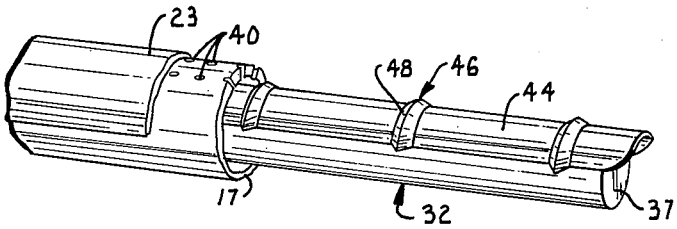
FIG. 3 is a partially cutaway view of the steam tube showing the construction and position of the baffle.

A generally concave, longitudinally extending insert or baffle portion 44 is sandwiched between heating tube portion 33 and shell 17 in the vicinity of holes 40. The baffle 44 is preferably constructed of a thin sheet of metal such as brass or the like. As best seen in FIG. 3, baffle 44 is provided with a plurality of spaced apart parallel corrugations 46. The corrugations 46, which are generally triangular or domed in profile, have an apex 48 which contacts the inner surface of shell 17 to form arcuate passages 49 from the side edges of the baffle to the vicinity of the exhaust openings 40.

OPERATION

In the preferred manner of operation the user first removes syringe 24 and fills it with treatment fluid (usually water) by squeezing bulb 25. After the syringe is reattached by penetrating orifice 30 with stem 27, the instrument is plugged into a conventional AC outlet, whereupon energization of the heater element will produce heat. At this time bulb 25 may be manually squeezed to inject fluid from reservoir 26 into steam chamber 19. As fluid within the steam chamber contacts heating tube 32 vaporization will occur and vapor will be discharged steam through the passage holes 40. Curls of hair may be wound around steam tube 16 for treatment and secured thereto with clamp 20. During the curling process baffle 44 will prevent the flow of water directly through holes 40 while allowing the passage of steam, so that the instrument may be positioned as desired by the operator without fear of fluid leakage.

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A hair curling instrument adapted to heat or dispense steam to curls of hair wound thereon, the instrument comprising:

handle means adapted to be grasped by the user;

steam tube means for producing and dispensing steam, said tube means interconnected with said handle means and comprising a tubular, cylindrical outer shell, said shell having a plurality of steam passage holes defined therein, a generally cylindrical heating tube located interiorly of said shell in coaxial relationship therewith, said heating tube including means for producing heat to vaporize liquid in contact with said heating tube, a steam chamber adapted to receive liquid, said steam chamber being in contact with said heating tube and communicating with said steam passage holes, baffle means in said steam chamber, said baffle means comprising a thin sheet of material curved to conform generally with the inside curvature of said tube and disposed within said tube and between said means for producing heat and said holes and including spacer means spacing said sheet from the inside of the tube to permit flow of steam between said sheet and the inside of the tube to and out through the holes, and means for injecting liquid into said steam chamber.

2. The combination as in claim 1, said spacer means comprising protuberances formed in said sheet.

* * * * *